US006565617B2

(12) United States Patent
Kalghatgi

(10) Patent No.: US 6,565,617 B2
(45) Date of Patent: May 20, 2003

(54) GASOLINE COMPOSITION

(75) Inventor: Gautam Tavanappa Kalghatgi, Chester (GB)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 09/918,743

(22) Filed: Jul. 31, 2001

(65) Prior Publication Data

US 2002/0166283 A1 Nov. 14, 2002

(30) Foreign Application Priority Data

Aug. 24, 2000 (EP) ..... 00307296

(51) Int. Cl.[7] ..... C10L 1/02
(52) U.S. Cl. ..... 44/451; 585/14
(58) Field of Search ..... 44/451; 585/14

(56) References Cited

U.S. PATENT DOCUMENTS

| | | | | |
|---|---|---|---|---|
| 2,819,953 A | | 1/1958 | Brown et al. | 44/70 |
| 3,065,065 A | * | 11/1962 | Sutton | 44/363 |
| 3,086,037 A | * | 4/1963 | Coffield | 556/136 |
| 3,088,814 A | * | 5/1963 | Gorsich | 44/320 |
| 3,106,194 A | * | 10/1963 | Cantwell | 123/1 A |
| 5,470,358 A | | 11/1995 | Gaughan | 44/426 |
| 6,241,791 B1 | | 6/2001 | Trotta et al. | 44/451 |

FOREIGN PATENT DOCUMENTS

| | | |
|---|---|---|
| JP | 08073870 | 3/1996 |

* cited by examiner

*Primary Examiner*—Cephia D. Toomer

(57) ABSTRACT

The invention provides an unleaded gasoline composition comprising a major amount of hydrocarbons boiling in the range from 30° C. to 230° C. and 2% to 20% by volume, based on the gasoline composition, of diisobutylene, the gasoline composition having Research Octane Number (RON) in the range 91 to 101, Motor Octane Number (MON) in the range 81.3 to 93, and relationship between RON and MON such that (a) when $101 \geqq RON > 98$, $(57.65+0.35\ RON) \geqq MON > (3.2\ RON-230.2)$, and (b) when $98 \geqq RON \geqq 91$, $(57.65+0.35\ RON) \geqq MON \geqq (0.3\ RON+54)$, with the proviso that the gasoline composition does not contain a MON-boosting aromatic amine optionally substituted by one or more halogen atoms and/or $C_{1-10}$ hydrocarbyl groups; a process for the preparation of such a gasoline composition; and a method of operating an automobile powered by a spark-ignition engine equipped with a knock sensor, with improved power output.

6 Claims, No Drawings

GASOLINE COMPOSITION

FIELD OF THE INVENTION

This invention relates to gasoline compositions, and more particularly to unleaded gasoline compositions, their preparation and use.

BACKGROUND OF THE INVENTION

Since the phasing out of lead additives from gasoline began, oxygenates, and particularly methyl tertiary butyl ether (MTBE) and tertiary butyl alcohol (TBA) have been widely used as octane boosters. More recently, particularly in USA, concern has emerged over contamination of groundwater from accidental spills of unleaded gasoline from underground storage tanks. MTBE and TBA are slow to degrade in groundwater, and MTBE can impart a noticeable unpleasant taste to drinking water in concentrations at the parts per billion level.

U.S. Pat. No. 2,819,953 (Brown and Shapiro, ass. Ethyl) discloses the use of certain fluoro-substituted amines, of formula

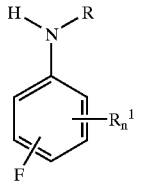

where R is hydrogen, alkyl, cycloalkyl, aryl, alkaryl or aralkyl; preferably limited to groups containing at most 10 carbon atoms, R is an alkyl group, preferably of from 1 to 4 carbon atoms, and n is 0 or an integer from 1 to 4. Example III (Column 2 lines 40 to 50) discloses addition of 70 parts of p-fluoroaniline to 1000 parts of a synthetic fuel consisting of 20% v toluene, 20% v diisobutylene, 20% v isooctane and 40% v n-heptane.

Example IV discloses addition of 59 parts of N-methyl-p-fluoroaniline to 1000 parts of the same synthetic fuel.

Table I (Column 4, lines 10 to 20) indicates that the Research Octane Number (RON) of the synthetic fuel itself is 77.1, that incorporation of 2.56% p-fluoroaniline raises the RON to 86, 2.16% of N-methyl-p-fluoroaniline raises the RON to 84.2, 2.56% of aniline raises the RON to 80.1, and 2.16% of aniline raises the RON to 79.7.

U.S. Pat. No. 5,470,358 (Gaughan, ass. Exxon) discloses the motor octane number (MON) boosting effect of aromatic amines optionally substituted by one or more halogen atoms and/or $C_{1-10}$ hydrocarbyl groups in boosting MON of unleaded aviation gasoline base fuel to at least about 98. The aromatic amines are specifically those of formula

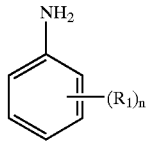

where $R_1$ is $C_{1-10}$ alkyl or halogen and n is an integer from 0 to 3, provided that when $R_1$ is alkyl, it cannot occupy the 2- or 6-positions on the aromatic ring. Example 5 (Column 6, lines 10 to 45) refers specifically to the above synthetic fuel of Example III of U.S. Pat. No. 2,819,953, and discloses that the MON of that fuel per se is 71.4, and that incorporation of 6% w variously of N-methylphenylamine, phenylamine, N-methyl-4-fluorophenylamine, 4-fluorophenylamine, N-methyl-2-fluoro-4-methylphenylamine and 2-fluorophenyl-4-methylphenylamine increased the MON from 71.4 respectively to 87.0, 85.8, 86.2, 84.5, 81.2 and 82.6.

Aromatic amines optionally substituted by one or more halogen atoms and/or $C_{1-10}$ hydrocarbyl groups tend to be toxic, and aniline is a known carcinogen. On toxicity grounds, their presence in gasoline compositions is therefore undesirable.

Japanese Patent Application JP08073870-A (Tonen Corporation) discloses gasoline compositions for two-cycle engines containing at least 10% v $C_{7-8}$ olefinic hydrocarbons and having 50% distillation temperature 93–105° C., a final distillation temperature 110–150° C. and octane number (by the motor method) (i.e. MON) of at least 95. Available olefins include 1- and 3-heptene, 5-methyl-1-hexene, 2,3,3-trimethyl-1-butene, 4,4-dimethyl -2-pentene, 1,3-heptadiene, 3-methyl-1,5-hexadiene, 1-octene, 6-methyl-1-heptene, 2,4,4-trimethyl-1-pentene and 3,4-dimethyl-1,5-hexadiene. These compositions are said to achieve high output and low fuel consumption and do not cause seizure even at high compression ratios.

SUMMARY OF THE INVENTION

It has now been found possible to provide a gasoline composition capable of producing advantageous power outputs when used as fuel in a spark-ignition engine equipped with a knock sensor, by incorporating diisobutylene in certain gasoline compositions having RON of at least 91 and MON not exceeding 93.

According to the present invention there is provided an unleaded gasoline composition comprising a major amount of hydrocarbons boiling in the range from 30° C. to 230° C. and 2% to 20% by volume, based on the gasoline composition, of diisobutylene, the gasoline composition having Research Octane Number (RON) in the range 91 to 101, Motor Octane Number (MON) in the range 81.3 to 93, and relationship between RON and MON such that (a) when $101 \geqq RON > 98$, $(57.65+0.35\ RON) \geqq MON > (3.2\ RON-230.2)$, and (b) when $98 \geqq RON \geqq 91$, $(57.65+0.35\ RON) \geqq MON \geqq (0.3\ RON+54)$, with the proviso that the gasoline composition does not contain a MON-boosting aromatic amine optionally substituted by one or more halogen atoms and/or $C_{1-10}$ hydrocarbyl groups.

DETAILED DESCRIPTION OF THE INVENTION

Gasolines typically contain mixtures of hydrocarbons boiling in the range from 30° C. to 230° C., the optimal ranges and distillation curves varying according to climate and season of the year. The hydrocarbons in a gasoline as defined above may conveniently be derived in known manner from straight-run gasoline, synthetically-produced aromatic hydrocarbon mixtures, thermally or catalytically cracked hydrocarbons, hydrocracked petroleum fractions or catalytically reformed hydrocarbons and mixtures of these. Oxygenates may be incorporated in gasolines, and these include alcohols (such as methanol, ethanol, isopropanol, tert.butanol and isobutanol) and ethers, preferably ethers containing 5 or more carbon atoms per molecule, e.g. methyl tert.butyl ether (MTBE). The ethers containing 5 or more carbon atoms per molecule may be used in amounts up to 15% v/v, but if methanol is used, it can only be in an amount up to 3% v/v, and stabilisers will be required. Stabilisers may also be needed for ethanol, which may be used up to 5% v/v. Isopropanol may be used up to 10% v/v, tert-butanol up to 7% v/v and isobutanol up to 10% v/v.

For reasons described above, it is preferred to avoid inclusion of tert.butanol or MTBE. Accordingly, preferred gasoline compositions of the present invention contain 0 to 10% by volume of at least one oxygenate selected from methanol, ethanol, isopropanol and isobutanol.

Advantageously, a gasoline composition of the present invention may contain 5% to 20% by volume of diisobutylene.

Diisobutylene is also known as 2,4,4-trimethyl-1-pentene.

Further preferred gasoline compositions of the present invention are compositions wherein MON is in the range 82 to 93 and the relationship between RON and MON is such that (a) when $101 \geqq RON > 98.5$, $(57.65+0.35\ RON) \geqq MON > (3.2\ RON-230.2)$, and (b) when $98.5 \geqq RON \geqq 91$, $(57.65+0.35\ RON) \geqq MON \geqq (0.4\ RON+45.6)$.

The present invention additionally provides a process for the preparation of a gasoline composition as defined above which comprises admixing a major amount of hydrocarbons boiling in the range from 30° C. to 230° C. and 2% to 20% by volume, based on the gasoline composition, of diisobutylene.

Gasoline compositions as defined above may variously include one or more additives such as anti-oxidants, corrosion inhibitors, ashless detergents, dehazers, dyes and synthetic or mineral oil carrier fluids. Examples of suitable such additives are described generally in U.S. Pat. No. 5,855,629.

Additive components can be added separately to the gasoline or can be blended with one or more diluents, forming an additive concentrate, and together added to the gasoline.

Still further in accordance with the present invention there is provided a method of operating an automobile powered by a spark-ignition engine equipped with a knock sensor, with improved power output, which comprises introducing into the combustion chambers of said engine a gasoline composition as defined above.

The invention will be further understood from the following illustrative examples thereof, in which, unless otherwise indicated, parts, percentages and ratios are by volume, and temperatures are in degrees Celsius.

In the examples which follow, fuel blends were formulated from isooctane, n-heptane, xylene, tertiary butyl peroxide (TBP), methyl tertiary butyl ether (MTBE), di-isobutylene (DIB) and alkylate, platformate, light straight run, isomerate and raffinate refinery components set forth in Table 1 following:

TABLE 1

| Property | Alkylate 1 (A1) | Alkylate 2 (A2) | Platformate 1 (P1) | Platformate 2 (P2) | Light Straight Run (LSR) | Isomerate (I) | Paffinate (R) |
|---|---|---|---|---|---|---|---|
| Hydrocarbon type content (% v/v) | | | | | | | |
| Paraffins | 0.00 | 5.20 | 5.54 | 7.15 | 46.05 | 4.0 | 24.55 |
| Iso-Paraffins | 98.60 | 90.96 | 15.70 | 16.19 | 36.64 | 87.73 | 58.87 |
| Olefins | 0.00 | 0.85 | 0.62 | 0.67 | 0.02 | 0.00 | 7.02 |
| Naphthenes | 0.04 | 0.10 | 1.72 | 2.26 | 14.51 | 4.43 | 7.97 |
| Aromatics (ASTM D 1319:1995) | 1.30 | 0.30 | 71.64 | 71.60 | 3.82 | 2.99 | 1.24 |
| Benzene content (% v/v) (EN 12177:1998) | 0.00 | 0.05 | 4.16 | 3.63 | 3.20 | 0.15 | 0.32 |
| Sulphur content (Mg/kg) (EN ISO 14596:1998) | 4 | 10 | 2 | 1 | 3 | 7 | 10 |
| Reid Vapour Pressure RVP (hPa) (mbar) | 510 | 490 | 323 | 278 | 910 | 964 | 239 |
| Distillation (° C.) | | | | | | | |
| IBP | 32 | 35 | 42 | 45 | 30 | 33.5 | 51 |
| T10 % v | | 72 | 87 | 88.5 | | 39 | 64 |
| T50 % v | 103 | 103 | 126 | 127.5 | 54 | 45 | 79 |
| T90 % v | 137 | 120 | 165 | 165.5 | 73 | 66 | 82 |
| FBP | 207 | 194 | 211 | 209.5 | 117 | 138 | 123 |
| Research Octane Number RON (ASTM D 2699) | 94.0 | 95.8 | 102 | 101.4 | 71.9 | 87.9 | 67.1 |
| Motor Octane Number MON (ASTM D 2700) | 91.8 | 92.5 | 90.5 | 89.7 | 68.8 | 85.5 | 64.8 |
| Density (at 15° C.) ($kg/m^3$) (EN ISO 12185) | 702.3 | 697.0 | 823.6 | 822.5 | 670.4 | 654.6 | 676.7 |

The fuel blends of Examples 1 to 11 (containing DIB) and Comparative Examples A to Q (not containing DIB) are set forth in Table 2 following:

TABLE 2

| Example | DIB (% v) | Other Components (% v) | RON | MON | AKI | COND MAX | COND MIN |
|---|---|---|---|---|---|---|---|
| 1 | 15 | 72.25% isooctane, 12.75% n-heptane | 94.4 | 89.8 | 92.1 | 90.7 | 82.3 |
| 2 | 10 | 76.5% isooctane, 13.5% n-heptane | 91.6 | 89.1 | 90.35 | 89.7 | 81.5 |
| 3 | 20 | 68% isooctane, 12% n-heptane | 96.5 | 90.1 | 93.3 | 91.4 | 83 |
| 4 | 20 | 80% A1 | 100.5 | 92.2 | 96.35 | 92.8 | 91.4 |
| 5 | 10 | 90% A1 | 97.9 | 91.6 | 94.75 | 91.9 | 83.4 |
| 6 | 5 | 95% A1 | 97 | 91.5 | 94.25 | 91.6 | 83.1 |
| 7 | 15 | 38% P2, 32% LSR, 15% I | 94.6 | 84.8 | 89.7 | 90.8 | 82.4 |
| 8 | 17 | 39% P2, 44% R | 92.4 | 83 | 87.7 | 90 | 81.7 |
| 9 | 18 | 60% P2, 22% LSR | 98.8 | 86.6 | 92.7 | 92.2 | 86 |
| 10 | 19.25 | 36.1% P2, 30.4% LSR, 14.25% I | 95.9 | 85.7 | 90.8 | 91.2 | 82.8 |
| 11 | 20 | 30% P2, 50% R | 91.7 | 83.2 | 87.45 | 89.7 | 81.5 |
| Comp. A | 0 | 90% A1, 10% P1 | 94.8 | 91 | 92.9 | 90.8 | 82.4 |
| Comp. B | 0 | 75% A1, 25% isooctane | 95.5 | 93.8 | 94.65 | 91.0 | 82.6 |
| Comp. C | 0 | 95% A1, 5% xylene | 95.7 | 92.1 | 93.9 | 91.1 | 82.7 |
| Comp. D | 0 | 98% isooctane, 2% n-heptane | 98 | 98 | 98 | 92.0 | 83.4 |
| Comp. E | 0 | 90% A1, 10% xylene | 96.6 | 92.2 | 94.4 | 91.5 | 83.0 |
| Comp. F | 0 | 95% A1, 5% MTBE | 95.9 | 93 | 94.45 | 91.2 | 82.8 |
| Comp. G | 0 | 96% isooctane, 4% n-heptane | 96 | 96 | 96 | 91.3 | 82.8 |
| Comp. H | 0 | 100% A1 | 94 | 91.8 | 92.9 | 90.6 | 82.2 |
| Comp. I | 0 | isooctane containing 0.6% w/v TBP | 94 | 92 | 93 | 90.6 | 82.2 |
| Comp. J | 0 | 90% A1, 10% MTBE | 97.6 | 92 | 94.8 | 91.8 | 83.3 |
| Comp. K | 0 | 80% A1, 20% MTBE | 100.6 | 95.3 | 97.95 | 92.9 | 91.7 |
| Comp. L | 0 | 100% isooctane | 100 | 100 | 100 | 92.7 | 89.8 |
| Comp. M | 0 | 93% isooctane, 7% n-heptane | 93 | 93 | 93 | 90.2 | 81.9 |
| Comp. N | 0 | 94% isooctane, 6% n-heptane | 94 | 94 | 94 | 90.6 | 82.2 |
| Comp. O | 0 | 97% isooctane, 3% n-heptane | 97 | 97 | 97 | 91.6 | 83.1 |
| Comp. P | 0 | 92% isooctane, 8% n-heptane | 92 | 92 | 92 | 89.7 | 81.6 |
| Comp. Q | 0 | commercial base gasoline blend | 95.1 | 88.4 | 91.75 | 90.9 | 82.5 |

The commercial base gasoline blend of Comp. Q was 77% paraffins, 1.4% naphthenes 20.4% aromatics, 0.6% olefins; 0.3% benzene; RVP 529 hPa (mbar); sulphur 3 ppmw.

In Table 2 above, AKI, Anti-Knock Index, is the average of RON and MON ((RON)+MON)/2), and is posted on dispensing pumps at retail gasoline outlets in USA (under the abbreviation (R+M)/2). COND MAX is the upper limiting value for MON and COND MIN is the lower limiting value for MON for the given RON value according to the provisions:

(a) $101 \geqq RON > 98$, $(57.65+0.35\ RON) \geqq MON > (3.2\ RON-230.2)$, and (b) $98 \geqq RON \geqq 91$, $(57.65+0.35\ RON) \geqq MON \geqq (0.3\ RON+54)$.

It will be noted that in the case of each of Examples 1 to 11, the MON value falls within the range permitted by provisions (a) and (b) above. In the case of the comparison examples, all of which fall outside the scope of the present invention, by virtue of containing no DIB, Comp. A to Comp. P have MON values above the COND MAX value allowed by provisions (a) and (b) above, whilst Comp. Q has a MON within the range allowed by provisions (a) and (b) above.

In the tests which follow it will be shown via single cylinder engine tests that the fuels of Examples 1 to 11 give lower knock intensities under the same engine operating conditions as the most closely corresponding fuels of the comparative examples. Some further tests were effected on a chassis dynamometer using a car equipped with a knock sensor, namely a SAAB 9000 2.3t, as will be hereinafter described.

Single Cylinder Engine Test

The test was conducted using a single cylinder "RICARDO HYDRA" (trade mark) engine of 500 ml displacement (bore 8.6 cm, stroke 8.6 cm, connecting rod length 14.35 cm). The engine was a 4-valve pent-roof engine with centrally mounted spark plug. Compression ratio was 10.5, exhaust valve opening at 132 crank angle degrees, exhaust valve closing at 370 crank angle degrees, intake valve opening at 350 crank angle degrees and intake valve closing at 588 crank angle degrees. Oil temperature and coolant temperature were maintained at 80° C.

Pressure was measured with a "KISTLER" (trade mark) 6121 pressure transducer and pressure signals were analysed using an "AVL INDISKOP" (trade mark) analyser. Fuel/air mixture strength was monitored using a "HORIBA EXSA-1500" (trade mark) analyser, and was maintained within 0.2% of the stoichiometric value (lamda=1). The fluctuating pressure signal associated with knock was extracted by filtering the pressure signal between 5 kHz and 10 kHz using electronic filters, amplified electronically, and the maximum amplitude of this fluctuating pressure signal was measured every engine cycle. The average of the maximum amplitude values over 400 consecutive cycles was taken as a measure of knock intensity. The sensitivity of the pressure transducer was set at 50 bar=1V. With this sensitivity, calibration of the whole system showed that an average maximum amplitude of the signal of 1V was equivalent to a knock intensity (peak to peak amplitude of the knock signal) of 1.064 bar. In the results which follow, knock intensity (KI) is presented in terms of average maximum amplitude of the knock signal in volts.

In a typical experiment the following steps were followed:

1. The engine is first run on stabilisation conditions (3000 RPM, full throttle) for 15 minutes on unleaded gasoline of 95 RON.
2. Bring engine to operating condition (Ignition at 2 degrees after top dead centre, Full throttle, 1200 RPM).
3. Switch to test fuel and run for 5 minutes.

4. Monitor mixture strength using the "Horiba" analyser, adjust fuel injection pulse to get lambda=1.
5. Advance ignition till evidence of knock is seen on pressure signal.
6. Retard ignition by 1 degree.
7. Note is made on test sheet of Test No., Ignition Timing, brake torque and knock intensity.
8. Advance ignition by 0.5 degrees and repeat step 7 till knock intensity exceeds 0.8 V.
9. Drain existing fuel, switch to the next fuel and repeat steps 3 to 8.

Thus the knock intensity (KI) is measured at different ignition timings.

As ignition is advanced for a given fuel, the engine knocks more and knock intensity increases.

Knock limited spark advance (KLSA) is defined as the ignition timing when knock intensity (KI) exceeds a chosen threshold value. Values of KLSA, in units of crank angle degrees (CAD), at different threshold values of KI, were recorded, and results are given in Tables 3 to 13 following for each of Examples 1 to 11 in comparison with the respective most closely comparable (in terms of RON) of the comparative examples. For the experiments recorded in Tables 3 to 8, which form one internally coherent series (Series I), KLSAs were measured at KIs of 0.25v (KLSA 1), 0.5v (KLSA 2) and 0.8v (KLSA 3). At this stage, the engine was reassembled on a different test bed, after removing engine deposits. The experiments in Tables 9 to 13 then followed, and form a different internally consistent series (Series II) in which the engine was less prone to knock on any given fuel compared to Series I. In Series II, KLSAs were measured at KIs of 0.4v (KLSA 4) and 0.8v (KLSA 5). The larger the value of KLSA, the lower is the knock intensity at a given ignition timing, and the more resistant the fuel is to knock.

TABLE 3

(Series I)

| Example | DIB % | RON | MON | AKI | KLSA 1 (CAD) | KLSA 2 (CAD) | KLSA 3 (CAD) |
|---|---|---|---|---|---|---|---|
| 1 | 15 | 94.4 | 89.8 | 92.1 | 2.4 | 3.3 | 4.05 |
| Comp. A | 0 | 94.8 | 91 | 92.9 | 1.2 | 2.1 | 2.7 |
| Comp. B | 0 | 95.5 | 93.8 | 94.65 | −0.2 | 0.85 | 1.7 |
| Comp. C | 0 | 95.7 | 92.1 | 93.9 | 0.45 | 1.85 | 2.65 |
| Comp. F | 0 | 95.9 | 93 | 94.45 | −0.45 | 0.65 | 1.65 |
| Comp. G | 0 | 96 | 96 | 96 | −2.3 | −0.93 | 0.3 |

TABLE 4

(Series I)

| Example | DIB % | RON | MON | AKI | KLSA 1 (CAD) | KLSA 2 (CAD) | KLSA 3 (CAD) |
|---|---|---|---|---|---|---|---|
| 2 | 10 | 91.6 | 89.1 | 90.35 | 0.25 | 1.2 | 1.9 |
| Comp. H | 0 | 94 | 91.8 | 92.9 | −0.45 | 0.53 | 1.4 |
| Comp. I | 0 | 94 | 92 | 93 | −2.2 | −2 | −1.4 |
| Comp. B | 0 | 95.5 | 93.8 | 94.65 | −0.2 | 0.85 | 1.7 |
| Comp. F | 0 | 95.9 | 93 | 94.45 | −0.45 | 0.65 | 1.65 |
| Comp. G | 0 | 96 | 96 | 96 | −2.3 | −0.93 | 0.3 |

TABLE 5

(Series I)

| Example | DIB % | RON | MON | AKI | KLSA 1 (CAD) | KLSA 2 (CAD) | KLSA 3 (CAD) |
|---|---|---|---|---|---|---|---|
| 3 | 20 | 96.5 | 90.1 | 93.3 | 4.2 | 5.5 | 6.7 |
| Comp. J | 0 | 97.6 | 92 | 94.8 | 4.1 | 5.35 | 6.6 |
| Comp. D | 0 | 98 | 98 | 98 | −0.3 | 1.6 | 2.6 |
| Comp. E | 0 | 96.6 | 92.2 | 94.4 | 2.3 | 3.7 | 4.8 |

TABLE 6

(Series I)

| Example | DIB % | RON | MON | AKI | KLSA 1 (CAD) | KLSA 2 (CAD) | KLSA 3 (CAD) |
|---|---|---|---|---|---|---|---|
| 4 | 20 | 100.5 | 92.2 | 96.35 | 10.1 | 12.5 | 14.5 |
| Comp. K | 0 | 100.6 | 95.3 | 97.95 | 7.46 | 10.8 | 14.3 |

TABLE 7

(Series I)

| Example | DIB % | RON | MON | AKI | KLSA 1 (CAD) | KLSA 2 (CAD) | KLSA 3 (CAD) |
|---|---|---|---|---|---|---|---|
| 5 | 10 | 97.9 | 91.6 | 94.75 | 5.7 | 7.5 | 8.93 |
| Comp. L | 0 | 100 | 100 | 100 | 5.4 | 7.2 | 8.5 |
| Comp. D | 0 | 98 | 98 | 98 | −0.3 | 1.6 | 2.6 |

TABLE 8

(Series I)

| Example | DIB % | RON | MON | AKI | KLSA 1 (CAD) | KLSA 2 (CAD) | KLSA 3 (CAD) |
|---|---|---|---|---|---|---|---|
| 6 | 5 | 97 | 91.5 | 94.25 | 1.4 | 2.5 | 3.3 |
| Comp. D | 0 | 98 | 98 | 98 | −0.3 | 1.6 | 2.6 |

TABLE 9

(Series II)

| Example | DIB % | RON | MON | AKI | KLSA 4 (CAD) | KLSA 5 (CAD) |
|---|---|---|---|---|---|---|
| 7 | 15 | 94.6 | 84.8 | 89.7 | 6.3 | 7.7 |
| Comp. Q | 0 | 95.1 | 88.4 | 91.75 | 5.9 | 7.1 |
| Comp. G | 0 | 96 | 96 | 96 | 5.2 | 6.4 |

TABLE 10

(Series II)

| Example | DIB % | RON | MON | AKI | KLSA 4 (CAD) | KLSA 5 (CAD) |
|---|---|---|---|---|---|---|
| 8 | 17 | 92.4 | 83 | 87.7 | 4.5 | 5.5 |
| Comp. M | 0 | 93 | 93 | 93 | 2.1 | 3.0 |
| Comp. N | 0 | 94 | 94 | 94 | 3.2 | 4.3 |

TABLE 11

(Series II)

| Example | DIB % | RON | MON | AKI | KLSA 4 (CAD) | KLSA 5 (CAD) |
|---|---|---|---|---|---|---|
| 9 | 18 | 98.8 | 86.6 | 92.7 | 11.0 | 13.1 |
| Comp. L | 0 | 100 | 100 | 100 | 9.4 | 10.9 |

TABLE 12

(Series II)

| Example | DIB % | RON | MON | AKI | KLSA 4 (CAD) | KLSA 5 (CAD) |
|---|---|---|---|---|---|---|
| 10 | 19.25 | 95.9 | 85.7 | 90.8 | 7.4 | 8.6 |
| Comp. G | 0 | 96 | 96 | 96 | 5.2 | 6.4 |
| Comp. O | 0 | 97 | 97 | 97 | 7.3 | 8.4 |

TABLE 13

(Series II)

| Example | DIB % | RON | MON | AKI | KLSA 4 (CAD) | KLSA 5 (CAD) |
|---|---|---|---|---|---|---|
| 11 | 20 | 91.7 | 83.2 | 87.45 | 3.3 | 4.6 |
| Comp. P | 0 | 92 | 92 | 92 | 1.1 | 2.1 |
| Comp. M | 0 | 93 | 93 | 93 | 2.1 | 3.0 |
| Comp. N | 0 | 94 | 94 | 94 | 3.2 | 4.3 |

From Tables 3 to 13, it will be seen that each of the fuels of Examples 1 to 11 has surprisingly higher values of KLSA than those of the Comparative Examples of higher but comparable RON and higher AKI but not containing DIB.

Car Tests on Chassis Dynamometer

The car used was a SAAB 9000 2.3 t, which had a turbo-charged spark ignition engine of 2.3 l equipped with a knock sensor.

In a first series of tests, the fuel of Example 10 was used in comparison with that of Comp. G. Vehicle tractive effort (VTE) and acceleration times were measured for each fuel.

For each acceleration time three measurements were taken. At each fuel change, the car was conditioned with seven consecutive accelerations in $4^{th}$ gear, 75% throttle from 1500 RPM to 3500 RPM before taking the readings.

Within each sequence the temperature was constant to within 0.3° C. (mean 28° C.) and the barometric pressure (1005 mbar) and the humidity (relative humidity of 18%) also remained unchanged.

VTE was measured at full throttle in $4^{th}$ gear at 1500 RPM, 2500 RPM and 3500 RPM. In addition, three acceleration times were measured viz for 75% throttle acceleration in $4^{th}$ gear from 1200 RPM to 3500 RPM (AT1), for full throttle acceleration in $4^{th}$ gear from 1200 RPM to 3500 RPM (AT2) and in $5^{th}$ gear from 1200 RPM to 3300 RPM (AT3). The six performance parameters were measured on the car with the fuels used in the sequence 10/G/10/G/10/G.

Results are given in Table 14 following.

TABLE 14

| Fuel of | | | | VTE (kgf) at | | | Acceleration times (5) | | | |
|---|---|---|---|---|---|---|---|---|---|---|
| Example | RON | MON | AKI | 1500 rpm | 2500 rpm | 3500 rpm | Run | AT1 | AT2 | AT3 |
| 10 | 95.9 | 85.7 | 90.8 | 228 | 309 | 317 | 1 | 14.0 | 13.43 | 21.50 |
| | | | | | | | 2 | 13.98 | 13.43 | 21.58 |
| | | | | | | | 3 | 13.85 | 13.38 | 21.55 |
| Comp. G | 96 | 96 | 96 | 220 | 279 | 297 | 1 | 14.40 | 14.28 | 22.65 |
| | | | | | | | 2 | 14.43 | 14.35 | 22.65 |
| | | | | | | | 3 | 14.20 | 14.08 | 22.80 |
| 10 | 95.9 | 85.7 | 90.8 | 231 | 310 | 316 | 1 | 13.18 | 13.05 | 21.15 |
| | | | | | | | 2 | 13.23 | 13.08 | 21.13 |
| | | | | | | | 3 | 13.33 | 13.10 | 20.98 |
| Comp. G | 96 | 96 | 96 | 219 | 282 | 298 | 1 | 13.93 | 13.90 | 22.43 |
| | | | | | | | 2 | 14.05 | 14.10 | 22.40 |
| | | | | | | | 3 | 13.40 | 13.33 | 22.35 |
| 10 | 95.9 | 85.7 | 90.8 | 236 | 311 | 315 | 1 | 13.33 | 13.20 | 21.13 |
| | | | | | | | 2 | 13.38 | 13.18 | 21.20 |
| | | | | | | | 3 | 13.20 | 13.10 | 21.15 |
| Comp. G | 96 | 96 | 96 | 220 | 278 | 295 | 1 | 14.03 | 13.93 | 22.35 |
| | | | | | | | 2 | 13.50 | 14.10 | 22.35 |
| | | | | | | | 3 | 14.05 | 14.08 | 22.40 |
| Mean for 10 | 95.9 | 85.7 | 90.8 | 231.7 | 310 | 316 | | 13.49 | 13.21 | 21.26 |
| Mean for Comp. G | 96 | 96 | 96 | 219.7 | 279.7 | 296.7 | | 14.00 | 14.05 | 22.49 |

From Table 14, it can be seen that the fuel of Example 10, containing 19.25% DIB, gave surprisingly superior power and acceleration than that of Comp. G, which had similar RON, but significantly higher AKI.

In a second series of tests VTE values alone were measured, as above, with the difference that the fuel of Example 7 was tested in comparison with the commercial base gasoline blend of Comp. Q, in fuel sequence 7//Q/7/Q/7/Q/7.

TABLE 15

| Fuel of Example | RON | MON | AKI | VTE (kgf) at 1500 rpm | 2500 rpm | 3500 rpm |
|---|---|---|---|---|---|---|
| 7 | 94.6 | 84.8 | 89.7 | 214 | 302 | 300 |
| Comp. Q | 95.1 | 88.4 | 91.75 | 213 | 300 | 299 |
| 7 | 94.6 | 84.8 | 89.7 | 213 | 302 | 302 |
| Comp. Q | 95.1 | 88.4 | 91.75 | 213 | 301 | 298 |
| 7 | 94.6 | 84.8 | 89.7 | 216 | 303 | 299 |
| Comp. Q | 95.1 | 88.4 | 91.75 | 215 | 300 | 298 |
| 7 | 94.6 | 84.8 | 89.7 | 214 | 302 | 302 |
| Mean for 7 | 94.6 | 84.8 | 89.7 | 214.3 | 302.3 | 300.8 |
| Mean for Comp. Q | 95.1 | 88.4 | 91.75 | 213.7 | 300.3 | 298.3 |

It will be noted that despite having AKI two units lower than Comp. Q, the fuel of Example 7 gave more power output.

I claim:

1. An unleaded gasoline composition comprising a major amount of hydrocarbons boiling in the range from 30° C. to 230° C. and 2% to 20% by volume, based on the gasoline composition, of diisobutylene, the gasoline composition having Research Octane Number (RON) in the range 91 to 101, Motor Octane Number (MON) in the range 81.3 to 93, and relationship between RON and MON such that (a) when $101 \geqq RON > 98$, $(57.65+0.35\ RON) \geqq MON > (3.2\ RON-230.2)$, and (b) when $98 \geqq RON \geqq 91$, $(57.65+0.35\ RON) \geqq MON \geqq (0.3\ RON+54)$, with the proviso that the gasoline composition does not contain a MON-boosting aromatic amine optionally substituted by one or more halogen atoms and/or $C_{1-10}$ hydrocarbyl groups.

2. A gasoline composition according to claim 1 which contains 0 to 10% by volume of at least one oxygenate selected from methanol, ethanol, isopropanol and isobutanol.

3. A gasoline composition according to claim 1 which contains 5% to 20% by volume of diisobutylene.

4. A gasoline composition according to claim 1 wherein MON is in the range 82 to 93 and the relationship between RON and MON is such that (a) when $101 \geqq RON > 98.5$, $(57.65+0.35\ RON) \geqq MON > (3.2\ RON-230.2)$, and (b) when $98.5 \geqq RON \geqq 91$, $(57.65+0.35\ RON) \geqq MON \geqq (0.4\ RON+45.6)$.

5. A process for the preparation of a gasoline composition according to claim 1 which comprises admixing a major amount of hydrocarbons boiling in the range from 30° C. to 230° C. and 2% to 20% by volume, based on the gasoline composition, of diisobutylene.

6. A method of operating an automobile powered by a spark-ignition engine equipped with a knock sensor, with improved power output, which comprises introducing into the combustion chambers of said engine a gasoline composition according to claim 1.

* * * * *